US007686043B2

(12) United States Patent
Berger

(10) Patent No.: US 7,686,043 B2
(45) Date of Patent: Mar. 30, 2010

(54) CONTAINER FILLING APPARATUS INCLUDING CLEANING SYSTEM

(75) Inventor: Gerald Paul Berger, Cedar Rapids, IA (US)

(73) Assignee: Evergreen Packaging Inc., Memphis, TN (US)

( * ) Notice: Subject to any disclaimer, the term of this patent is extended or adjusted under 35 U.S.C. 154(b) by 1109 days.

(21) Appl. No.: 11/302,828

(22) Filed: Dec. 14, 2005

(65) Prior Publication Data

US 2007/0144610 A1 Jun. 28, 2007

(51) Int. Cl.
*B65B 1/04* (2006.01)

(52) U.S. Cl. ..... 141/91; 141/286; 141/287; 141/90

(58) Field of Classification Search ..... 141/2, 141/11, 90, 286, 91, 287; 222/148; 134/170, 134/166 C See application file for complete search history.

(56) References Cited

U.S. PATENT DOCUMENTS

| | | | | | |
|---|---|---|---|---|---|
| 3,716,083 | A | * | 2/1973 | Tuma et al. | 141/90 |
| 4,534,494 | A | * | 8/1985 | Hautemont | 222/148 |
| 4,971,087 | A | | 11/1990 | Benedetti et al. | |
| 4,987,934 | A | * | 1/1991 | Groom | 141/89 |
| 5,052,451 | A | * | 10/1991 | Gentilcore et al. | 141/67 |
| 5,316,056 | A | * | 5/1994 | Stott | 141/68 |
| 5,562,129 | A | * | 10/1996 | Graffin | 141/90 |
| 5,740,844 | A | | 4/1998 | Miller | |
| 5,782,274 | A | | 7/1998 | Kaneko et al. | |
| 5,845,683 | A | | 12/1998 | Sundby et al. | |
| 5,865,221 | A | * | 2/1999 | Ludwig et al. | 141/31 |
| 6,039,058 | A | | 3/2000 | Fujikawa et al. | |
| 6,056,918 | A | | 5/2000 | Palaniappan et al. | |
| 6,094,887 | A | | 8/2000 | Swank et al. | |
| 6,183,691 | B1 | | 2/2001 | Swank et al. | |
| 6,267,157 | B1 | * | 7/2001 | Gruson et al. | 141/90 |
| 6,401,771 | B1 | | 6/2002 | Kondo et al. | |
| 6,457,497 | B1 | * | 10/2002 | Adriansens et al. | 141/91 |
| 7,270,153 | B2 | * | 9/2007 | Stavrakis et al. | 141/1 |
| 2003/0101689 | A1 | | 6/2003 | Guillou | |

FOREIGN PATENT DOCUMENTS

| | | |
|---|---|---|
| EP | 0919517 | 6/2003 |
| EP | 1195325 | 4/2004 |
| JP | 04 279434 | 10/1992 |
| JP | 10 181796 | 7/1998 |
| WO | WO 01/42086 | 6/2001 |

* cited by examiner

*Primary Examiner*—Timothy L Maust
(74) *Attorney, Agent, or Firm*—Perkins Coie LLP

(57) ABSTRACT

A container filling apparatus includes a fill nozzle for directing a liquid product into a container and an adaptor including a nozzle interface to engage the fill nozzle for a cleaning operation. An expandable member is configured to expand into a gap between the adaptor and the fill nozzle to form a seal between the nozzle interface and the fill nozzle.

20 Claims, 7 Drawing Sheets

CONTAINER FILLING APPARATUS INCLUDING CLEANING SYSTEM

TECHNICAL FIELD

The present application relates generally to filling apparatus and more particularly to a container filling apparatus with a cleaning system.

BACKGROUND

Filling machines for use in filling a container with a liquid food product are often provided with a cleaning system for use in cleaning fill nozzles of the machine. Clean-in-place (CIP) devices have been proposed for use in periodically cleaning components, such as the fill nozzles, which contact the food product. Such CIP devices typically pump a cleaning solution through the fill nozzles to dislodge remaining food product and then a sanitizing solution is also pumped through the fill nozzles to limit microorganism growth and avoid product contamination. Use of CIP devices can reduce disassembly and cleaning of the machine components by hand through facilitating cleaning of the components on the machine.

Often times, cleaning solution is recycled through the machine during a cleaning operation. Fluid recovery manifolds have been developed for this purpose. The fluid recovery manifold can be positioned at the discharge outlets of the fill nozzles to capture the cleaning solution sent therethough and to direct the cleaning solution back toward a CIP pump which forces the cleaning solution again through the machine until the cleaning operation is complete. Since the fill nozzles are normally positioned at a container fill path for filling containers, the recovery manifold may be moveable into and out of position with respect to the fill nozzles.

SUMMARY

In an aspect, a container filling apparatus includes a fill nozzle for directing a liquid product into a container and an adaptor including a nozzle interface to engage the fill nozzle for a cleaning operation. An expandable member is configured to expand into a gap between the adaptor and the fill nozzle to form a seal between the nozzle interface and the fill nozzle.

In another aspect, a method of cleaning a fill nozzle of a container filling apparatus is provided. The method includes locating an adaptor adjacent the fill nozzle such that a gap is provided between a nozzle interface of the adaptor and the fill nozzle. An expandable member is expanded into the gap to bring the nozzle interface into contact with the fill nozzle.

The details of one or more embodiments of the invention are set forth in the accompanying drawings and the description below. Other features, objects, and advantages of the invention will be apparent from the description and the drawings, and from the claims.

DETAILED DESCRIPTION

Figure 1:
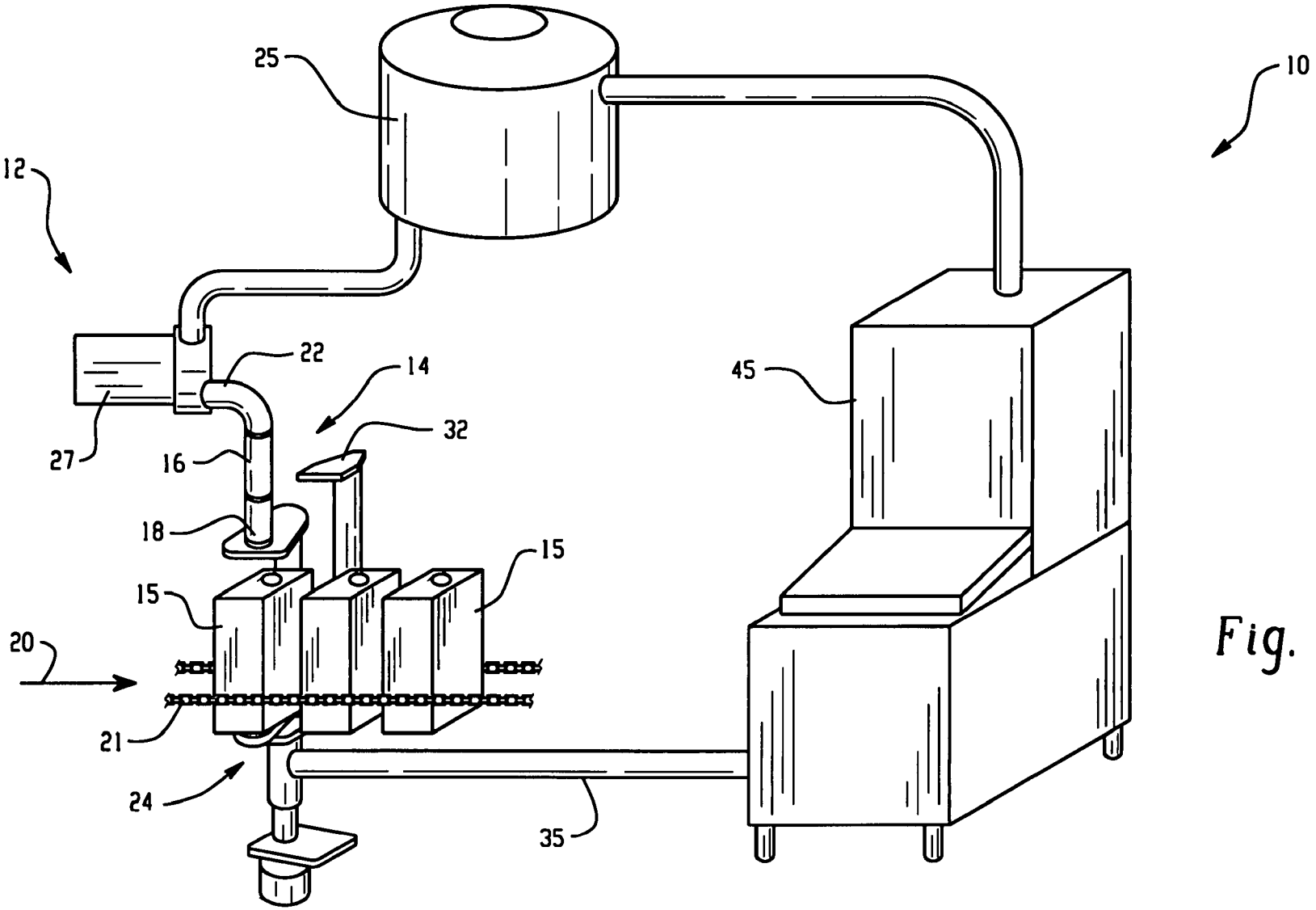
FIG. 1 is a partial, perspective view of components of an embodiment of a container filling apparatus.

Referring to FIG. 1, a container filling apparatus 10 includes a filling assembly 12 for use in filling containers 15 with a liquid food product and a cleaning assembly 14 for use in cleaning components of the filling assembly that come into contact with the food product during a filling operation. Filling assembly 12 includes a fill nozzle 16 having a discharge outlet 18 for use in directing the food product into the containers 15 disposed thereunder, carried along a container fill path 20 by a conveyor 21. An infeed conduit 22 is coupled to the fill nozzle 16 for delivering the food product to the fill nozzle, e.g., from a tank 25 using a product pump 27. While the fill nozzle 16 is shown as being substantially cylindrical in shape with substantially circular discharge outlet 18, the nozzle can be any suitable shape or combination of shapes. In some embodiments, the discharge outlets 18 may be square, for example.

Figure 2:
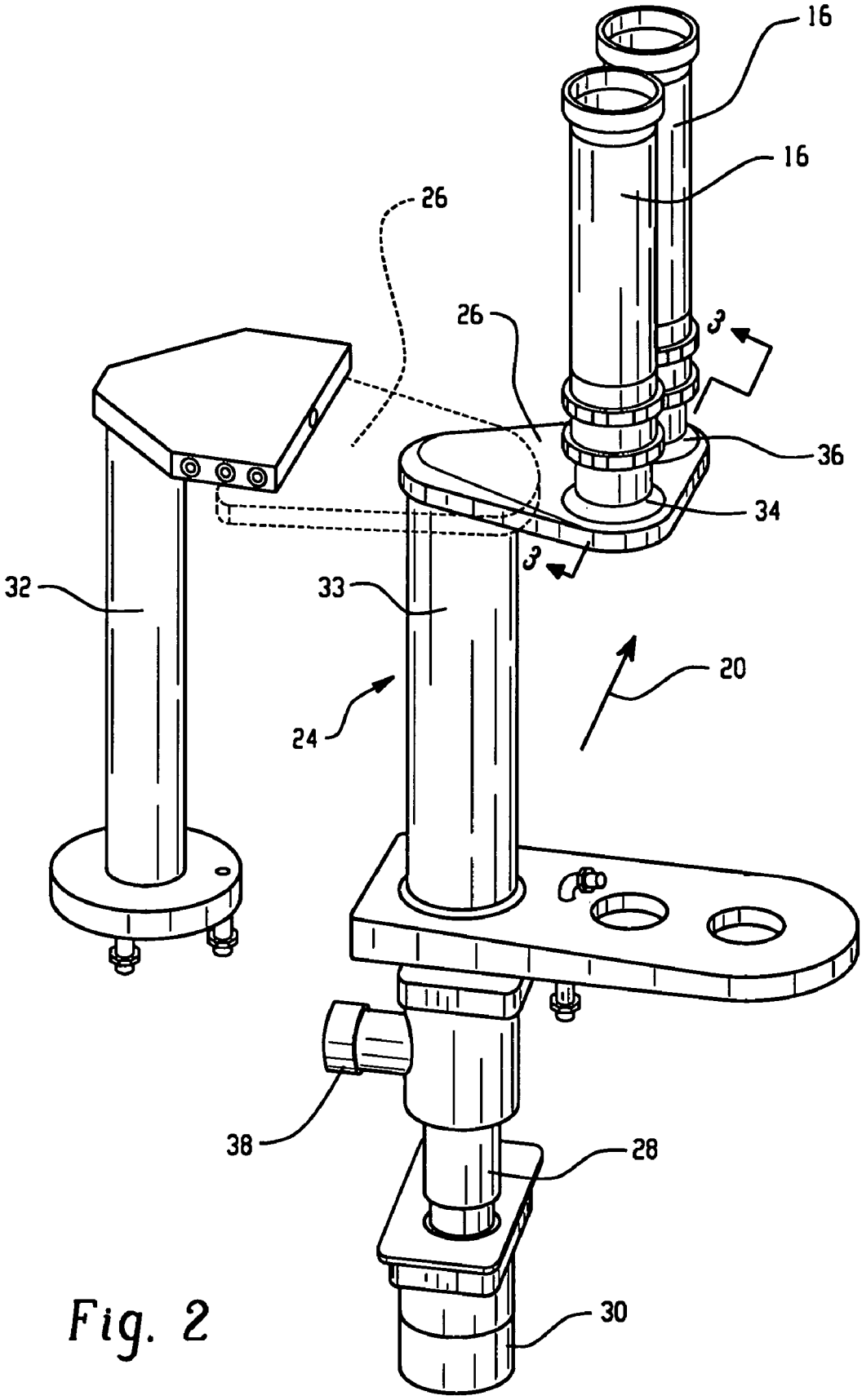
FIG. 2 is a partial, perspective view of selected container filling apparatus components.

Cleaning assembly 14 includes a cleaning device 24 capable of engagement with the fill nozzles 16 and a rinsing station 32 for use in rinsing the cleaning device. As can more clearly be seen by FIG. 2 showing a multiple fill nozzle 16 embodiment, cleaning device 24 and rinsing station 32 in isolation, cleaning device 24 includes an adaptor member 26, an inner mounting member 28 that supports the adaptor member 26, an outer mounting member 33 and a rotary actuator 30 (e.g., an electric motor, air cylinder, or other actuator capable of imparting rotational motion directly, or through use of a mechanical linkage) coupled to the inner mounting member for use in rotating the inner mounting member and adaptor member. The actuator 30 can rotate the inner mounting member 28 (e.g., 180 degrees, 360 degrees) to selectively locate the adaptor member 26 at the fill nozzles 16 for a cleaning operation or at the rinsing station 32 for a rinsing operation (see the dotted lines). The adaptor member 26 is used to connect the fill nozzles 16 to the cleaning device. The adaptor member 26 also facilitates movement of the cleaning device 24 from the rinsing station 32 to the fill nozzles 16 at the container fill path 20, as will be described below.

The adaptor member 26 and outer mounting member 33 each define a portion of a fluid passageway for directing cleaning solution flowing from the fill nozzles 16 to a discharge outlet 38 that is connected to a discharge conduit 35 (FIG. 1). The discharge conduit 35 can direct cleaning solution back to a pressurized fluid source, such as a pump 45 (FIG. 1), for reuse. In some embodiments, the discharge outlet 38 and conduit 35 may not direct cleaning solution back to the pump for reuse, for example, the solution may be discarded.

Figure 3:
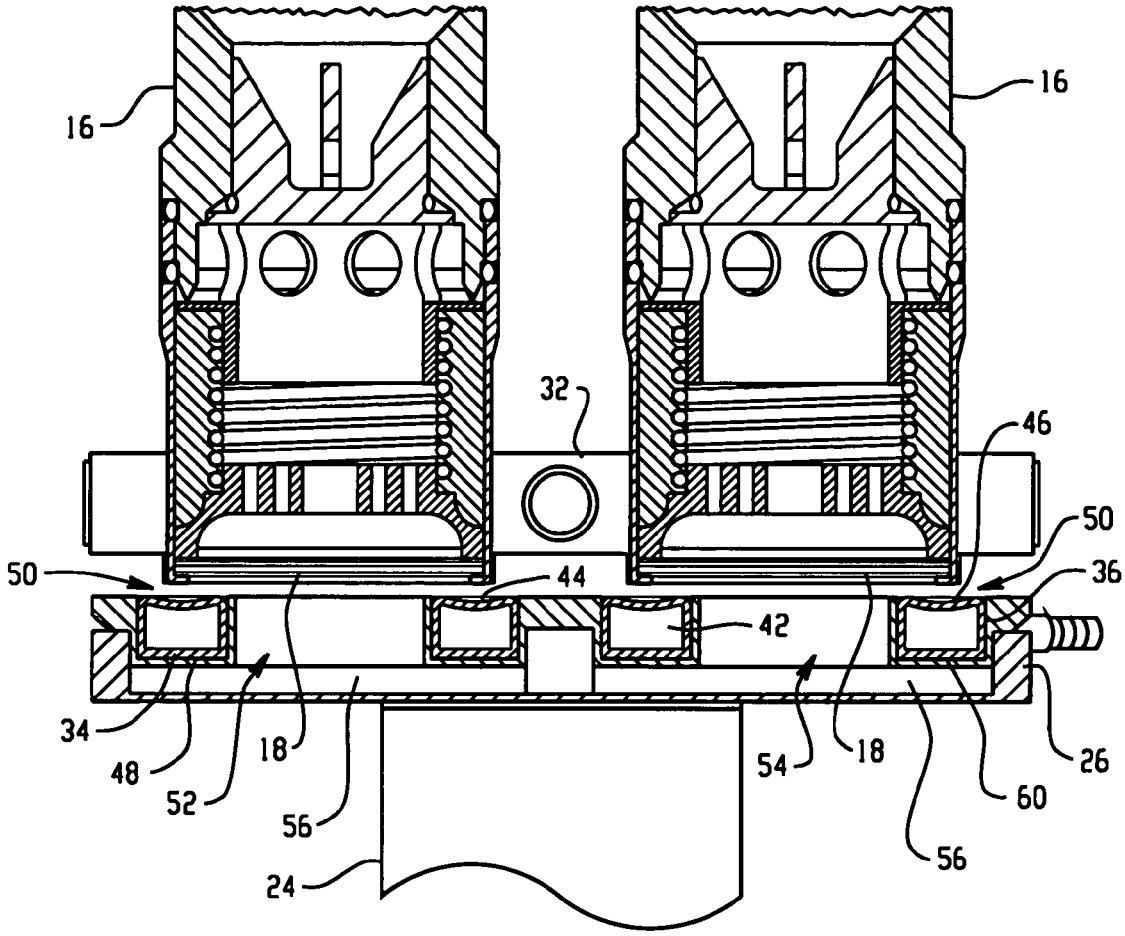
FIG. 3 is a partial, section view along line 3-3 of FIG. 2 showing a gap between the actuators and fill nozzles.

Referring now to FIG. 3, as noted above, the cleaning device 24 can rotate to locate the adaptor member 26 at the rinsing station 32 or at the fill nozzles 16. The adaptor member 26 is located at a height such that a gap 50 is provided between the adaptor member and the fill nozzles 16 once the adaptor member is positioned under the fill nozzles as shown by FIG. 3. In some embodiments, such as the one illustrated, the adaptor member 26 rotates through a substantially horizontal plane (i.e., the elevation of the adaptor member 26 remains substantially the same or is substantially fixed throughout rotation of the cleaning device 24 between the rinsing station 32 and the fill nozzles 16). In some embodiments, however, the adaptor member 24 may be otherwise moved (e.g., horizontally and/or vertically) to place the adaptor member 24 into position beneath the fill nozzles 16.

The adaptor member 26 includes expandable members 40, 42 that are used to place a nozzle interface surface 44, 46 in contact with the fill nozzles 16 at their respective discharge outlets 18. In the illustrated embodiment, the expandable members 40 and 42 are inflatable seals, each forming the nozzle interface surface 44, 46. Expandable members 40 and 42 are tubular and are shaped to correspond to the shape of the discharge outlet 18 of the fill nozzles 16. The expandable members 40, 42 are located within recesses 48 and 60 of the adaptor member 26. Openings 52 and 54 extend through the adaptor member 26 and expandable members 40 and 42 to receive fluid from the fill nozzles 16. A fluid passage 56 is in communication with the openings 52 and 54 and directs liquid through the cleaning device 24.

Figure 4:
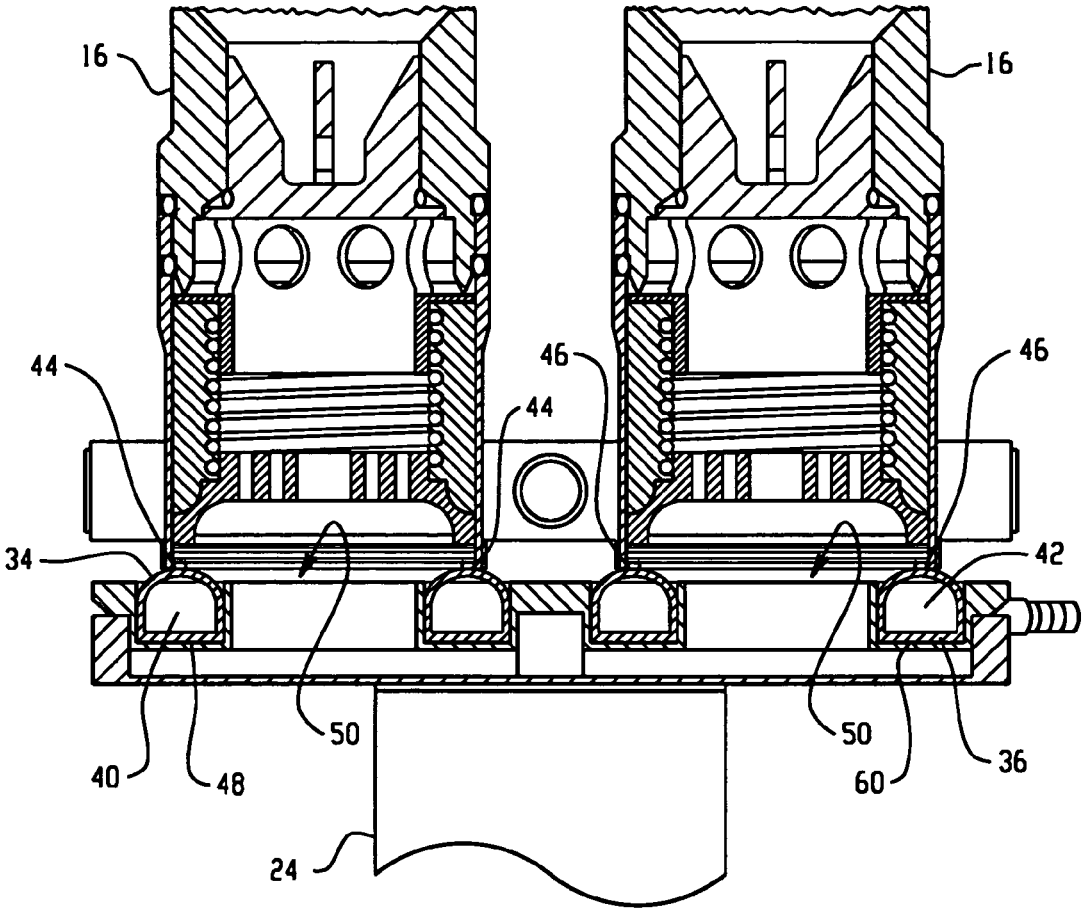
FIG. 4 is a partial, section view along line 3-3 of FIG. 2 with the actuators in contact with the fill nozzles.

Referring now to FIG. 4, the expandable members 40 and 42 can expand to fill the gap 50 between the fill nozzles 16 and the adaptor member 26 with the adaptor member placed under the fill nozzles. As used herein, the term "expand" means to make greater in at least one dimension. The expandable members 40 and 42 are constrained from expanding horizontally and downwardly away from the fill nozzles 16 by walls of the recesses 48 and 60. Recesses 48 and 60 are open upwardly toward the fill nozzles 16 to allow the expandable members 40 and 42 to expand in a vertical direction toward the fill nozzles, increasing the height of the expandable members from an initial height. By expanding, the expandable members 40 and 42 place the nozzle interface surfaces 44 and 46 into contact with the fill nozzles 16 to form a seal therebetween to inhibit unintended spillage or spraying of liquid flowing from the fill nozzles to the cleaning device 24.

Expandable members 40 and 42 can also contract (e.g., by deflation) from their expanded configuration as shown by FIG. 4. As used herein, the term "contract" means to make smaller in at least one dimension. Contracting the expandable members 40 and 42 provides the gap 50 between the adaptor member 26 and the fill nozzles 16 (FIG. 3). The gap 50 facilitates rotational movement of the cleaning device 24 as described above, for example, without any need for moving the cleaning device 24 vertically away from the fill nozzles 16 prior to rotation.

Any suitable material may be used to form the expandable members 40, 42. Preferably the expandable members 40, 42 are formed of a food contact grade material. In some embodiments, material forming the expandable members 40, 42 may be stretchable or elastic. In other embodiments, material forming the expandable members 40, 42 may be relatively non-stretchable or in-elastic. Combinations of materials may also be used to form the expandable members 40, 42.

Figure 5:
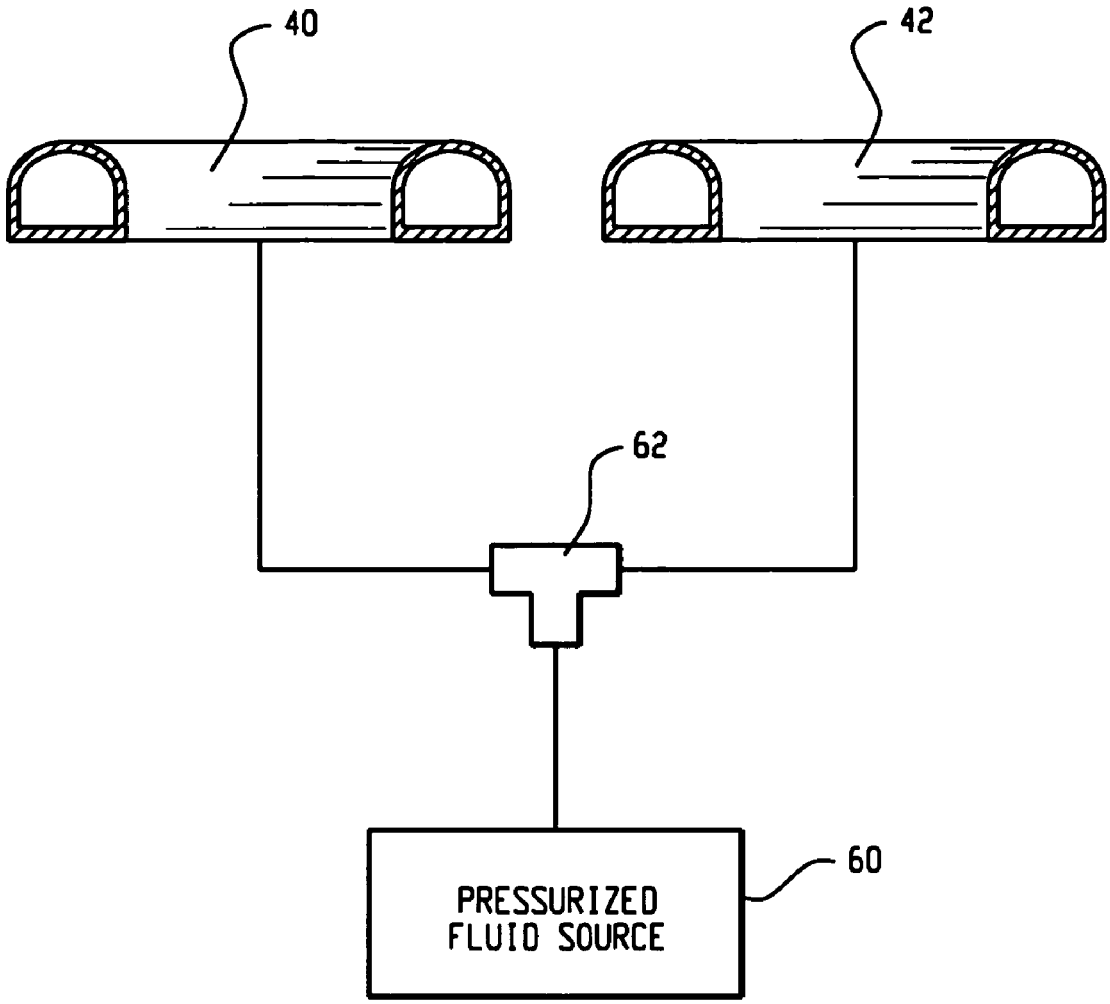
FIG. 5 is a diagrammatic view of an embodiment of a pressurized fluid delivery system for use in expanding expandable members.

Referring now to FIG. 5, any suitable method can be used to expand and/or contract the expandable members 40, 42. As noted above, the expandable members 40, 42 may be inflatable and coupled to, for example, a pressurized fluid source 60 (e.g., a pump, compressor, hydraulics, etc.) that can be used to deliver a pressurized fluid such as air or other gas or liquid to the expandable members. The expandable members 40 and 42 may be connected to the same pressurized fluid source (e.g., to expand the expandable member simultaneously) or to differing pressurized fluid sources (e.g., to allow the expandable members to be expanded at differing instances). The expandable members 40, 42 may be connected to a pump or other pressurized fluid source with a control valve 62 disposed therebetween that allows for controlled delivery of pressurized gas to the expandable members. A pressure generator 60 connected to the expandable members 40 and 42 may be reversible (or have a vacuum feature) to allow for both delivery and removal of fluid from the expandable members 40, 42. Such a vacuum feature can provide for predictable contraction of the expandable members 40, 42 each time the adaptor member 26 is to be moved. In some embodiments, a release valve may be utilized to release gas from the expandable members 40, 42 to allow them to contract from their expanded configurations.

It may desirable to include the expandable members 40, 42 in automated control of the cleaning system 14. In some embodiments, activation of the cleaning cycle by a machine operator's push button may start a sequence of events including the contraction of the expandable members 40, 42, movement of the adaptor member 26 from the rinse station 32 to the filling nozzles 16, and the expansion of the expandable members to engage the filling nozzles. The cleaning operation may then commence automatically. At the end of the cleaning cycle, the expandable members 40, 42 may automatically contract, the adaptor member 26 may move to the rinse station 32 automatically, and the expandable members may again expand. This part of the cycle can also be controlled manually, for example, so that operations such as emptying the product tank 25 (FIG. 1) and pipes between product changes could also be accomplished.

Figure 6:
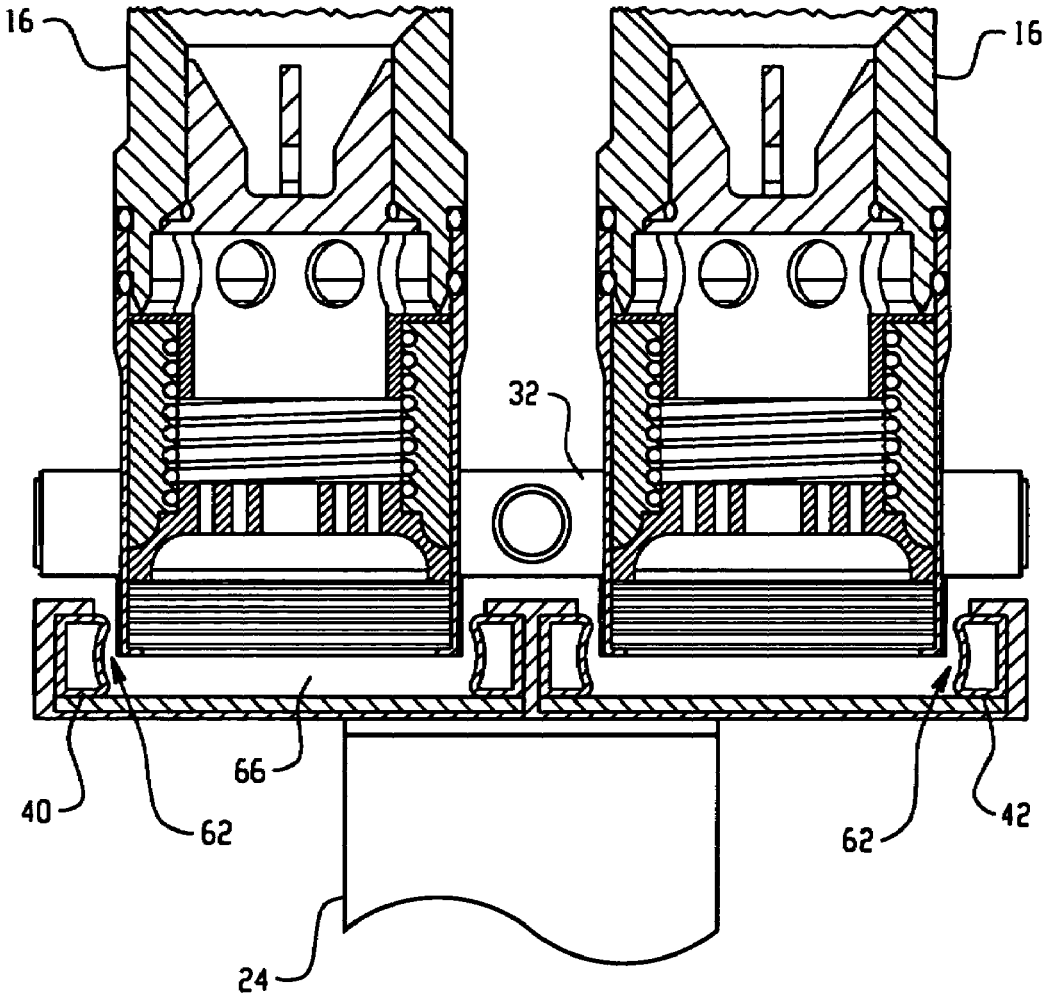
FIG. 6 is a partial, section view of another embodiment of a container filling apparatus.
Figure 7:
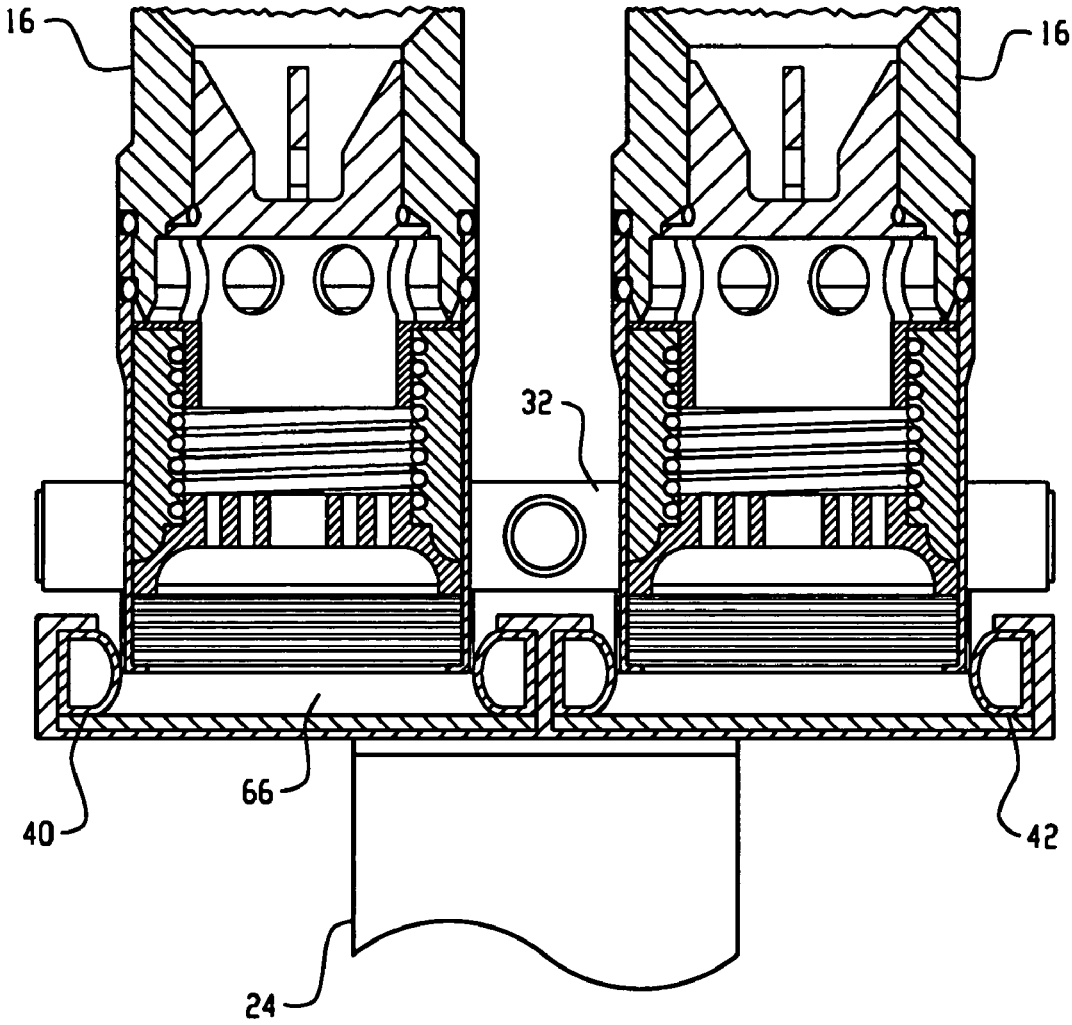
FIG. 7 is a partial, section view of the container filling apparatus of FIG. 6 with expandable members expanded radially.

Referring now to FIG. 6, the expandable members 40, 42 may expand in dimensions other than (or in addition to) vertically. FIG. 6 shows an embodiment where a horizontal (or radial) gap 62 is provided between an adaptor member 66 and the fill nozzles 16. Referring also to FIG. 7, the adaptor member 66 includes expandable members 40, 42 that can expand in a horizontal (or radial) dimension to contact the fill nozzles 16 and provide a seal therebetween.

A number of detailed embodiments have been described. Nevertheless, it will be understood that various modifications may be made. For example, in some instances, food product may be directed through the cleaning assembly 14 to allow for emptying of food product and changing food product. In these instances, rather than recycling the food product back through the machine, the food product may be discarded through the discharge outlet 38 and discharge conduit connected thereto. Accordingly, other embodiments are within the scope of the following claims.

What is claimed is:

1. A container filling apparatus comprising: a fill nozzle for directing a liquid product into a container; an adaptor including a nozzle interface to engage the fill nozzle for a cleaning operation, the adaptor having an opening extending through the adapter through which flows the cleaning solution from the fill nozzle; an expandable member configured to expand into a gap between the adaptor and the fill nozzle to form a seal between the nozzle interface and the fill nozzle, a mounting member that supports the adaptor adjacent the fill nozzle; and a rinsing station for use in rinsing the nozzle interface.

2. The container filling apparatus of claim 1, wherein the expandable member is an expandable seal that defines the nozzle interface.

3. The container filling apparatus of claim 1, wherein the expandable member is inflatable.

4. The container filling apparatus of claim 3 further comprising a pressurized fluid source coupled to the expandable member to inflate the expandable member.

5. The container filling apparatus of claim 1, wherein the mounting member is moveable to move the adaptor between the fill nozzle and the rinsing station.

6. The container filling apparatus of claim 5 further comprising a rotary actuator coupled to the mounting member to rotate the mounting member.

7. The container filling apparatus of claim 1, wherein the expandable member comprises a food contact grade material.

8. The container filling apparatus of claim 1, wherein the expandable member is tube-shaped having an opening extending therethrough that defines a passageway for receiving a cleaning fluid from the fill nozzle with the expandable member in an expanded configuration.

9. The container filling apparatus of claim 1, wherein the expandable member comprises an elastically expandable material.

10. The container filling apparatus of claim 1 comprising multiple fill nozzles; and multiple expandable members wherein each expandable member is configured to expand into an associated gap between the adaptor and a respective fill nozzle to form a seal between a respective nozzle interface and the respective fill nozzle.

11. The container filling apparatus of claim 1, wherein the expandable member is configured to contract from an expanded configuration to provide a gap between the fill nozzle and the adaptor.

12. A method of cleaning a fill nozzle of a container filling apparatus, the method comprising the steps of: providing a container filling apparatus according to claim 1; locating the adaptor adjacent the fill nozzle such that a gap is provided between the nozzle interface of the adaptor and the discharge outlet of the fill nozzle; and expanding the expandable member into the gap to bring the nozzle interface into contact with the discharge outlet of the fill nozzle.

13. The method of claim 12, wherein the expandable member defines the nozzle interface.

14. The method of claim 12, wherein the step of expanding the expandable member includes forming a seal between the nozzle interface and the fill nozzle.

15. The method of claim 14, wherein the step of expanding the expandable member connects a passageway extending therethrough to the fill nozzle.

16. The method of claim 12 further comprising delivering a pressurized fluid to the expandable member to expand the expandable member.

17. The method of claim 12, wherein the step of expanding includes stretching the expandable member.

18. The method of claim 12 further comprising contracting the expandable member after the step of expanding to provide a gap between the nozzle interface of the adaptor and the fill nozzle.

19. The container filling apparatus of claim 1 wherein the opening is defined by the nozzle interface.

20. The container filling apparatus of claim 1 wherein the expandable member contacts and forms the seal at the discharge outlet of the fill nozzle.

* * * * *